US005183300A

United States Patent [19]

Bonné et al.

[11] Patent Number: 5,183,300

[45] Date of Patent: Feb. 2, 1993

[54] FASTENING FOR A MOVABLE PART OF A MOTOR VEHICLE

[75] Inventors: Andreas Bonné, Wimberg; Klaus Claar, Gechingen; Jürgen Schrader, Stuttgart, all of Fed. Rep. of Germany

[73] Assignee: Mercedes-Benz AG, Fed. Rep. of Germany

[21] Appl. No.: 826,465

[22] Filed: Jan. 27, 1992

[30] Foreign Application Priority Data

Jan. 26, 1991 [DE] Fed. Rep. of Germany ..... 4102279

[51] Int. Cl.[5] ..... E05C 3/26

[52] U.S. Cl. ..... 292/216; 292/DIG. 5

[58] Field of Search ..... 292/216, 280, DIG. 23, 292/DIG. 24

[56] References Cited

U.S. PATENT DOCUMENTS

| | | | |
|---|---|---|---|
| 3,421,785 | 1/1969 | Slattery | 292/216 |
| 4,971,373 | 11/1990 | Hamada et al. | 292/DIG. 56 X |
| 4,988,135 | 1/1991 | Otting | 292/216 X |
| 5,048,877 | 9/1991 | Rogers, Sr. et al. | 292/216 X |

FOREIGN PATENT DOCUMENTS

| | | |
|---|---|---|
| 3126810 | 6/1985 | Fed. Rep. of Germany . |
| 3708095 | 7/1988 | Fed. Rep. of Germany . |
| 3801581 | 10/1988 | Fed. Rep. of Germany . |

*Primary Examiner*—Richard E. Moore

*Attorney, Agent, or Firm*—Evenson, Wands, Edwards, Lenahan & McKeown

[57] ABSTRACT

A fastening arrangement for a movable part especially a folding top or a roof of a motor vehicle. The arrangement includes a rotary latch which serves for securing a fastening pin of the movable part and is rotatable by means of an actuating device for a blocking and release of the fastening pin which can be retained by means of a detent pawl. In the locked position of the fastening, the detent pawl rests in an undercut principal notch of the rotary latch. High frictional forces and disturbing noises therefore are avoided during the unlocking operation. The rotary latch is rotatable through a specific angle oppositely to the blocking direction of the detent pawl by means of a control device activatable by the actuating device.

4 Claims, 3 Drawing Sheets

FASTENING FOR A MOVABLE PART OF A MOTOR VEHICLE

BACKGROUND AND SUMMARY OF THE INVENTION

The invention relates to a fastening arrangement for a movable part, especially a folding top or a roof, of a motor vehicle, with a rotary latch which serves for securing a fastening pin of the movable part and is rotatable by means of an actuating device for a blocking and release of the fastening pin and which can be retained by means of a detent pawl and is rotatable oppositely to the blocking direction of the detent pawl.

Such a fastening for a motor-vehicle tailgate is known from German Patent Document DE 3,801,581 C1. In this arrangement during the movement of opening the tailgate the detent pawl is pivoted into a release position not blocking the rotary latch, until the rotary latch has passed the preclosing position. Since the detent pawl does not block the rotary latch during this movement, the latter is also rotatable oppositely to the blocking direction of the detent pawl, for example as a result of pressure on the tailgate.

A fastening for a motor-vehicle folding top is known from German Patent Document DE 3,708,095 C2. With the folding-top fastening in the locked position, the rotary latch secures the fastening pin and is locked by means of the detent pawl engaging into its principal notch. Relatively high frictional forces between the rotary latch and detent pawl occur in this position as a result of the undercut in the principal notch of the rotary latch. During the unlocking of the fastening, the direction of movement of the rotary latch is reversed when the detent pawl is being shifted out at the mouth of the principal notch, the fastening at least partially unlocking itself as a result of the prestress caused by sealing forces. This reversal of movement can lead to noises during the release of the lock.

It is also known from German Patent Document DE 3,126,810 C2, in a motor-vehicle door fastening, to shift the detent pawl out by means of a control cam arranged on the rotary latch, in order to prevent knocks caused by impact.

An object of the invention is to provide a fastening arrangement of the type mentioned above, by means of which frictional forces and noises occurring during the operation of opening the movable part are reduced.

This object is achieved according to preferred embodiments of the invention in that there is a lever mechanism which can be activated by the actuating device and which positively guides the rotational movement, including a rotation opposite to the blocking direction of the detent pawl, of the rotary latch during the operation of opening and locking the movable part.

Contact between rotary latch and detent pawl is thereby largely eliminated during the operation of opening and locking the movable part, with the result that virtually no frictional forces occur any more between rotary latch and detent pawl. The wear of the parts of the fastening is consequently greatly reduced. Furthermore, the disturbing noises which occur in the state of the art during the operation of opening or closing the fastening and which were generated by the sudden reversal of the direction of movement of the rotary latch when the detent pawl was being shifted out are also prevented.

In a further embodiment of the invention, the lever mechanism has a control cam rotatable about the axis of rotation of the rotary latch and connected to the actuating device, and a rocker lever connected by means of a first slotted guide to the control cam and by means of a further slotted guide to pivotable driver and pivotable about an axis parallel to the axis of rotation. The mechanics of the lever mechanism are thus set in motion by the actuating device, so that the control of the rotary latch begins with the initiation of the opening operation by the actuating device.

In a further embodiment, the driver is connected by means of a slotted guide to an engagement point of the rotary latch located opposite the detent pawl. Consequently, by means of the driver the lever mechanism can impart to the rotary latch a pivoting opposite to the blocking direction between detent pawl and rotary latch.

In a further embodiment of the invention, the driver is prestressed against the rocker lever by means of a spring. Since the driver bears on the rocker lever, any control movement of the control cam is transmitted to it and therefore, via the engagement point, to the rotary latch.

Other objects, advantages and novel features of the present invention will become apparent from the following detailed description of the invention when considered in conjunction with the accompanying drawings.

DETAILED DESCRIPTION OF THE DRAWINGS

Figure 1:
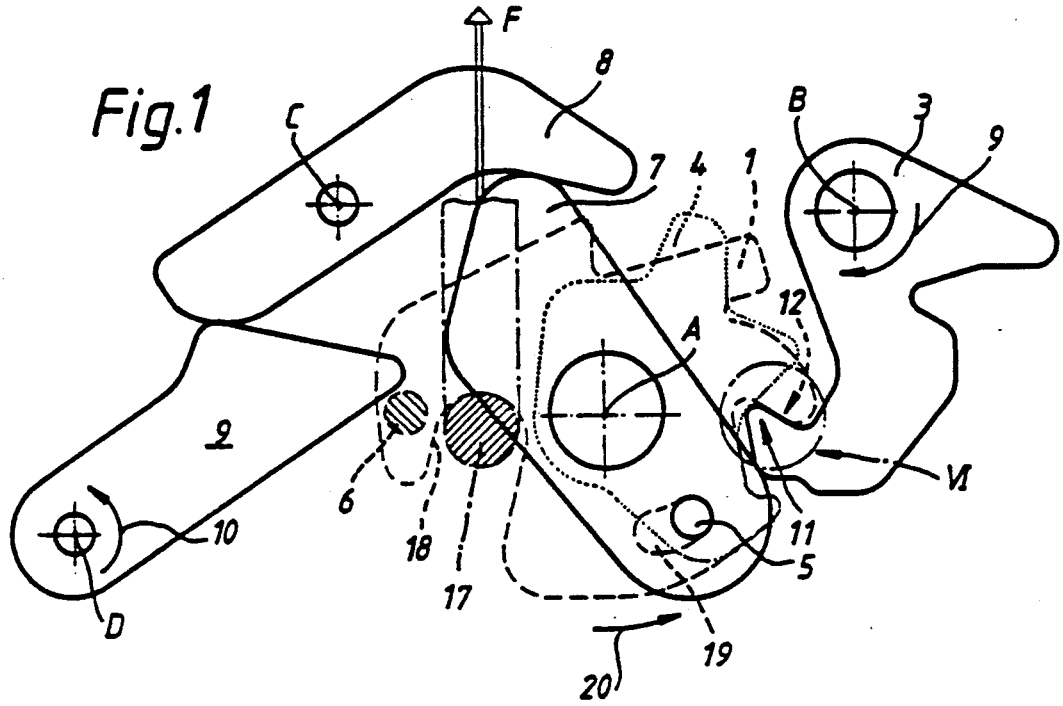
FIG. 1 shows a diagrammatic view of an embodiment of a fastening arrangement constructed according to the invention, in which the rotary latch can be controlled during the opening operation by an additional lever mechanism having a control cam, a rocker lever and a driver.
Figure 2:
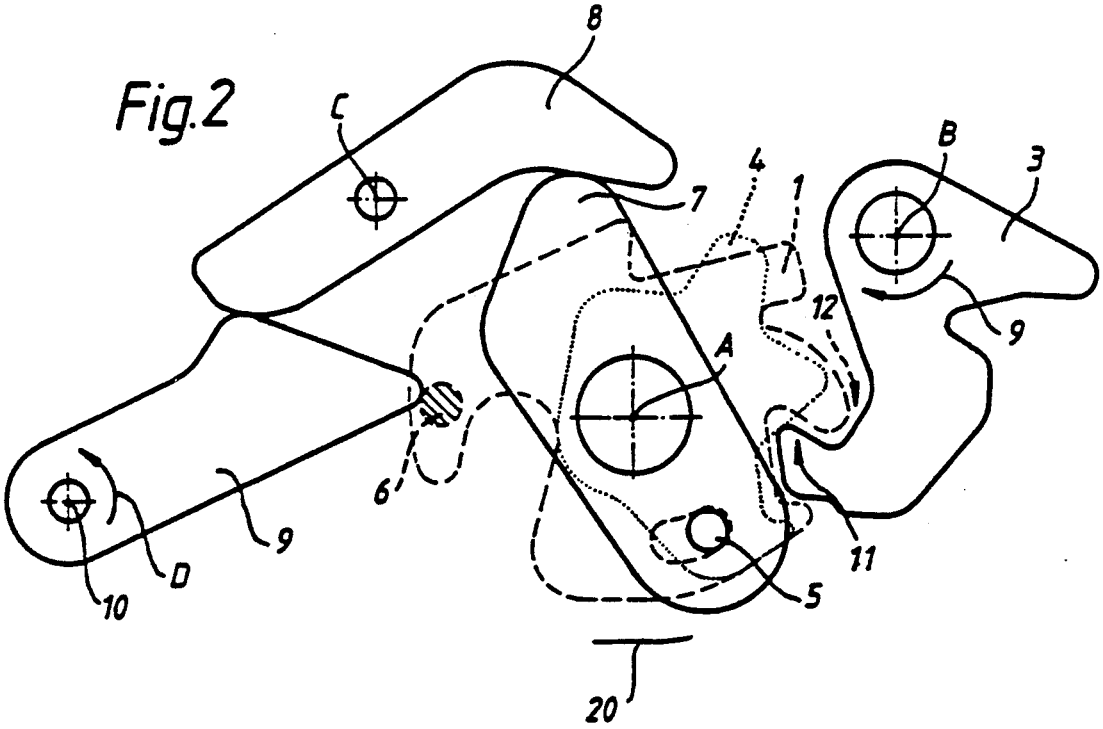
FIGS. 2 to 5 show several positions of the fastening arrangement according to FIG. 1 during the opening and closing operations.

FIG. 1 illustrates a fastening arrangement for a folding top of a passenger vehicle in its locked position. In the arrangement, a rotary latch (1) represented by broken lines engages by means of a recess (18) over a fastening pin (17), represented by dot-and-dash lines, of the folding top which is not shown. In the locked position, sealing forces of the folding to apply to the fastening pin a force (F) which, according to FIG. 1, exerts a torque in the clockwise direction on the rotary latch (1). The rotary latch (1) is mounted rotatably about an axis (A) and is retained in this position by means of a detent pawl (3) which engages by means of a hook-like extension (11) into an undercut principal notch (12) of the rotary latch (1). The detent pawl (3) is mounted pivotably about an axis (B) and is prestressed about this axis in the clockwise direction by means of a spring force (arrow 9). Guided movably in a long hole (19) of the rotary latch (1) is a bolt (5), on which an actuating device not shown engages in order to initiate the operation of opening or closing the rotary latch (1). For this operation, there is provided for example, a hydraulic cylinder which acts on the bolt (5) by means of a linkage. Connected firmly to the bolt (5) is a function disc (4), represented by dots, the outer contour of which is so designed that it serves as a slotted guide for shifting out the detent pawl (3) during the opening or closing operation. The construction and functioning of the hitherto described elements of the fastening are described in detail in German Patent Document DE-C-3,708,095, and therefore there is no need for further particulars here.

In the locked position of the rotary latch (1) according to FIG. 1, the extension (11) of the detent pawl (3) is located in the undercut part of the principal notch (12) of the rotary latch (1). During unlocking, the extension (11) is pressed out of the principal notch (12) by the function disc (4) and rubs against the undercut part which is pressed firmly against the extension (11) as a result of the force (F). High frictional forces are consequently generated during the unlocking. In order to prevent these frictional forces and the sudden reversal of the direction of movement of the rotary latch (1) occurring, while the detent pawl (3) is being shifted out, when these disappear after the mouth of the principal notch (12) has been reached, there is a lever mechanism which is described in more detail below.

The lever mechanism has a control cam (7) which is mounted rotatably about the axis (A) and connected rigidly to the bolt (5) and therefore to the function disc (4). At its end located opposite the bolt (5), the control cam (7) bears against the underside of a rocker lever (8) bent in a hook-like manner. This rocker lever (8) is mounted rotatably about an axis (C). The two end regions of the rocker lever (8) each form a slotted guide, specifically for the control cam (7) on the one hand and for a driver (9) on the other hand. This driver (9) is located, in the drawing plane of FIG. 1, on the left-hand side of the control cam (7) and underneath the rocker lever (8). It is mounted rotatably about an axis (D) ad is prestressed against the rocker lever (8) in the direction of the arrow (10) by means of a spring force. The driver (9) possesses at its free end two bosses which are arranged at a distance from one another and of which one bears on the rocker lever (8) in the position according to FIG. 1 and the other on an engagement point (6) of the rotary latch (1). A bolt or a bearing, especially a roller bearing, serves by way of example as an engagement point (6). The operating mode of the lever mechanism is now described below with reference to FIGS. 1 and 5.

Figure 3:
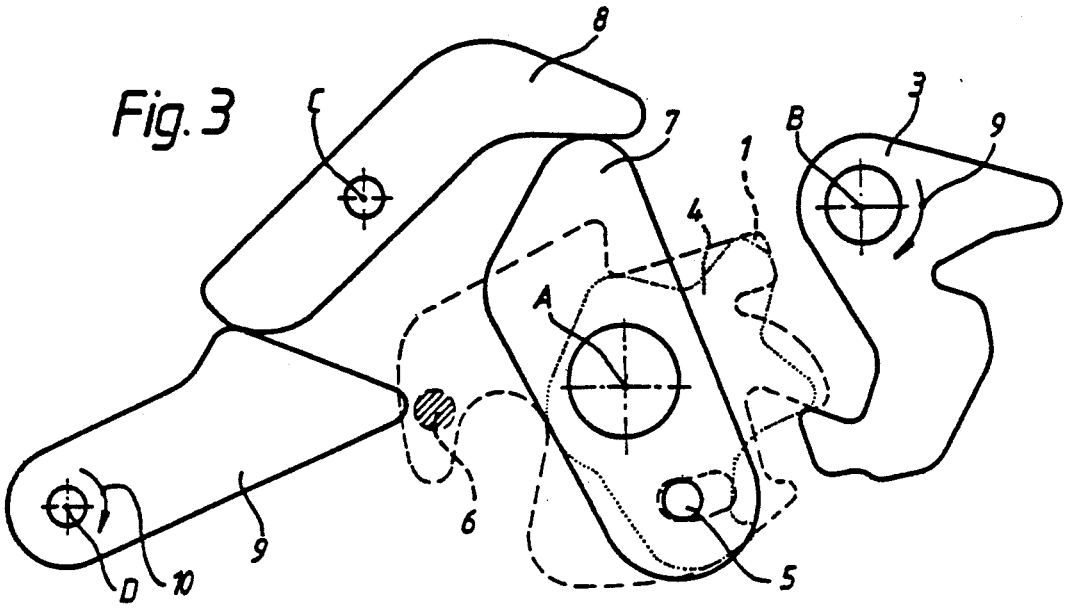
Figure 4:
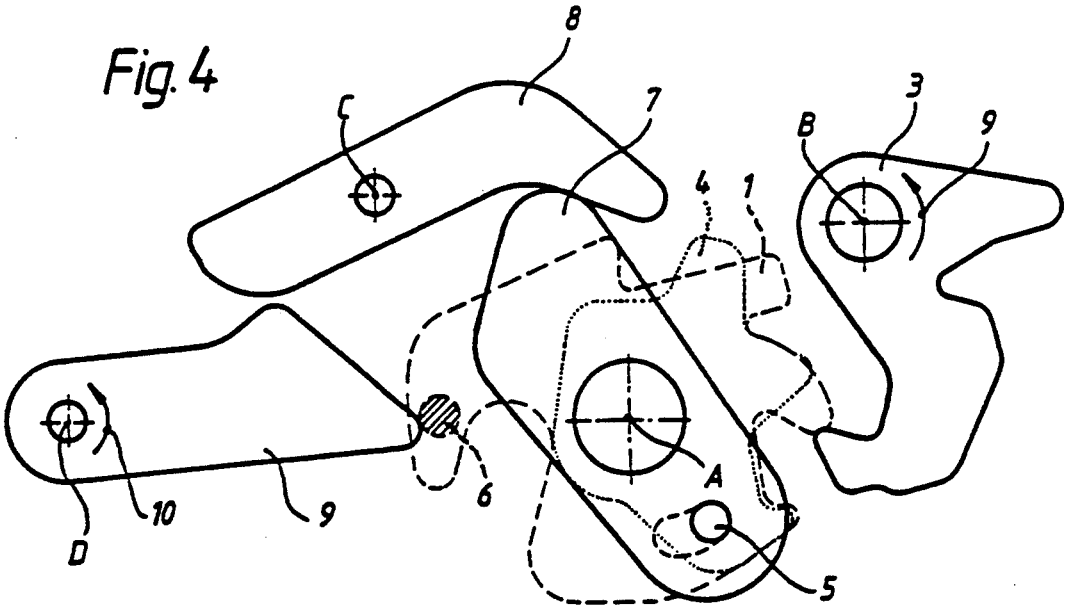

As soon as the unlocking operation is initiated by the actuating device, for example by the hydraulic cylinder, the function disc (4) rotates together with the control cam (7) in the clockwise direction about the axis (A). As a result of this movement, the control cam (7) drives the rocker lever (8) about the axis (C) in the anti-clockwise direction. The rocker lever (8) thereby exerts a load on the driver (9) about the axis (D) clockwise in the opposite direction to the arrow (10). This movement simultaneously causes a force to be applied to the engagement point (6) of the rotary latch (1), with the result that the rotary latch (1) rotates in anti-clockwise direction. This rotation therefore also takes place oppositely to the blocking direction between principal notch (12) and detent pawl (3). As a result of this rotation, a spacing occurs between the extension (11) of the detent pawl (3) and the outer contour of the rotary latch (1) in the principal notch (12), as is evident from FIG. 6. This spacing identified by the arrows (13) (FIG. 6) is maintained during the further unlocking operation, until the detent pawl (3) is shifted out of the principal notch (12) completely by the function disc (4) (FIGS. 3 and 4). Subsequently, the detent pawl (3) is brought up against the outer contour of the rotary latch (1) again. The driver (9) is simultaneously pressed downwards past the engagement point (6). The rotation of the rotary latch (1) thus takes place counter to the force (F) brought about by corresponding sealing means of the folding top. As soon as the rotary latch (1) is released completely, during its further opening movement it frees the fastening pin (17). The detent pawl (3) is therefore moved out of the principal notch (12) of the rotary latch (1) without contact, until the undercut is overcome, an it then reengages smoothly with the outer contour of the rotary latch (1).

Figure 5:
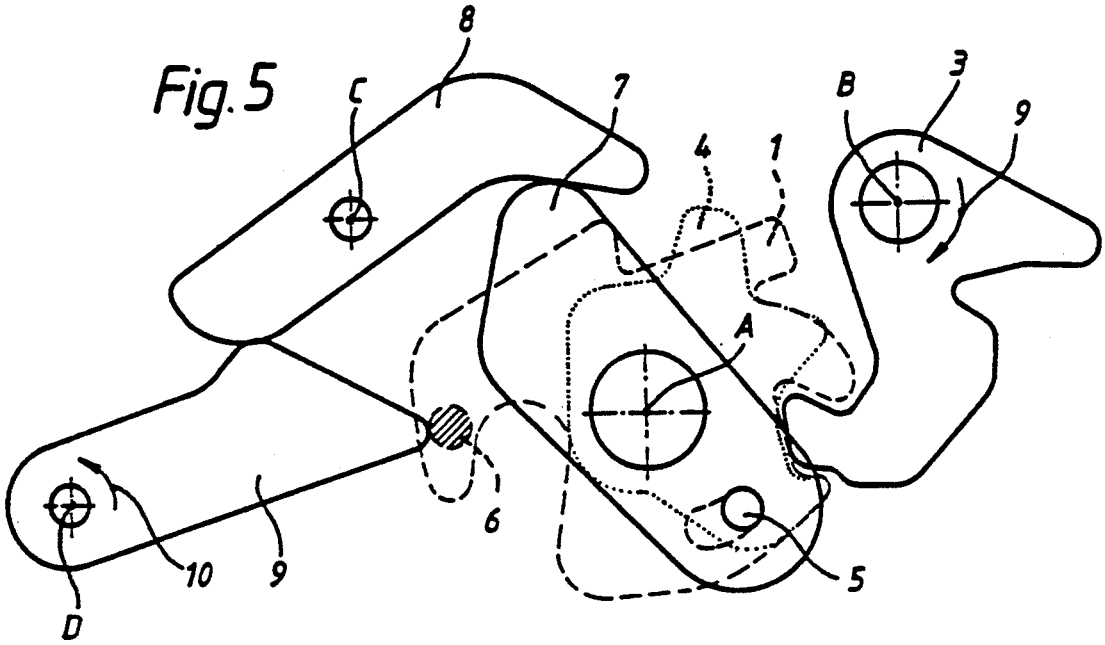

The locking of the fastening takes place in a similar way (FIGS. 4 and 5). For the sake of clarity, a representation of the fastening pin (17) has been omitted in these FIGS. In FIG. 4, this fastening pin (17) is already caught by means of a corresponding pre-catch position of the rotary latch (1.) The actuating device now acts on the bolt (5) and rotates the function disc (4) in the anti-clockwise direction. Because of the long hole (19), the function disc (4) has a lead over the rotary latch (1). As soon as the bolt (5) takes up the rotary latch (1), the engagement point (6) rotates and comes up against the driver (9). The driver (9) is thereby shifted downwards in the clockwise direction (FIG. 4). This load on the driver (9) by the engagement point (6) is maintained even when the detent pawl (3) subsequently drops into the principal notch (12) of the rotary latch (1). The rotary latch (1) is pulled further over the anti-clockwise direction by the actuating device (FIG. 5). The engagement point (6) thereby frees the driver (9). The driver (9) is now pressed against the rocker lever (8) once again by means of the spring prestress (arrow 10). The initial position is consequently resumed. The actuating device can now by switched off.

Figure 6:
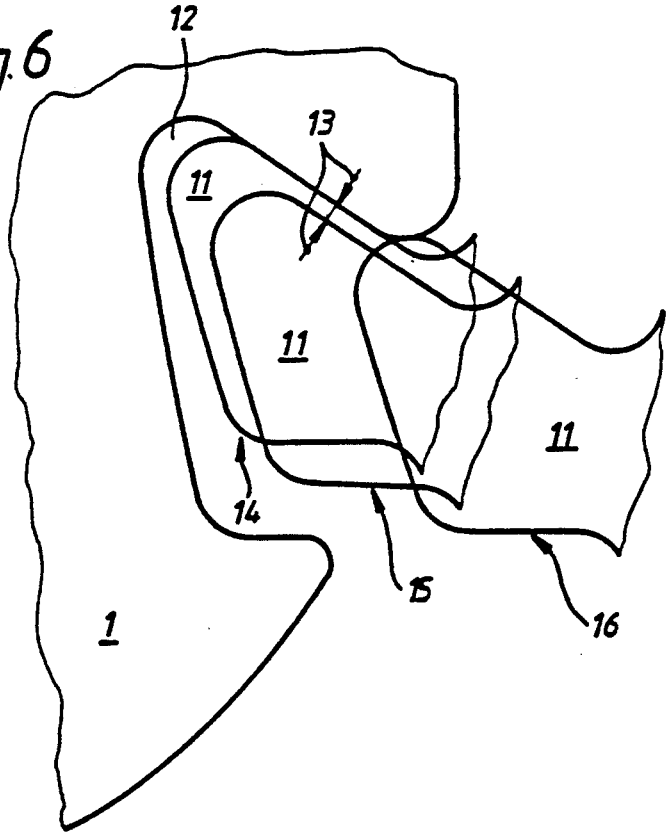
FIG. 6 shows, in an enlarged view of the cutout VI of FIG. 1, the position of the detent pawl in the principal notch of the rotary latch in three different phases of the shifting out of the detent pawl.

For the sake of greater clarity, the pulling over of the rotary latch (1) is illustrated in FIG. 6, three different positions (14, 15 and 16) of the extension (11) of the detent pawl (3) in the principal notch (12) being shown diagrammatically. The spacing (13) between detent pawl and rotar latch (1) is maintained during virtually the entire operation notch (12). Thus, the position (14) shows the locked initial position of the fastening, the position (15) a transitional phase during the unlocking operation and the position (16) the situation of the detent pawl (3) in which the undercut of the principal notch (12) is overcome.

In another embodiment of a fastening, a function disc (4) is omitted completely. This changes nothing in the construction and functioning of the lever mechanism other than the guiding features disclosed above the disc (4).

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. Fastening arrangement for a movable part such as a folding top or a roof of a motor vehicle, comprising:

a rotary latch which serves for securing a fastening pin of the movable part, an actuating device for rotating the rotary latch for a selective blocking and release of the fastening pin by the rotary latch, a detent pawl engageable with the rotary latch, said detent pawl being rotatable oppositely to the blocking direction of the detent pawl, and, a lever mechanism which can be activated by the actuating device and which positively guides the rotational movement, including a rotation opposite to the locking direction of the detent pawl, of the rotary latch during the operating of opening and locking the movable part.

2. Fastening arrangement according to claim 1, wherein the lever mechanism has a control cam rotatable about the axis of rotation of the rotary latch and connected to the actuating device, and a rocker lever connected by means of a first slotted guide to the control cam and by means of a further slotted guide to a pivotable driver and pivotable about an axis parallel to the axis of rotation.

3. Fastening according to claim 2, wherein the driver is connected by means of a slotted guide to an engagement point of the rotary latch located opposite the detent pawl.

4. Fastening according to claim 2 wherein the driver is prestressed against the rocker lever by means of a spring.

* * * * *